US006935143B2

(12) United States Patent
Nitsche

(10) Patent No.: US 6,935,143 B2
(45) Date of Patent: Aug. 30, 2005

(54) WASHING-MACHINE LAUNDRY DRUM

(75) Inventor: Alfred Nitsche, Berlin (DE)

(73) Assignee: BSH Bosch und Siemens Hausgeräte GmbH, Munich (DE)

( * ) Notice: Subject to any disclaimer, the term of this patent is extended or adjusted under 35 U.S.C. 154(b) by 51 days.

(21) Appl. No.: 10/873,401

(22) Filed: Jun. 21, 2004

(65) Prior Publication Data

US 2005/0005654 A1 Jan. 13, 2005

Related U.S. Application Data

(63) Continuation of application No. PCT/EP02/09350, filed on Aug. 21, 2002.

(30) Foreign Application Priority Data

Dec. 21, 2001 (DE) ..... 101 63 186

(51) Int. Cl.[7] ..... D06F 37/04
(52) U.S. Cl. ..... 68/142; 68/24; 68/58
(58) Field of Search ..... 68/24, 58, 142, 68/139, 143

(56) References Cited

U.S. PATENT DOCUMENTS 1,356,422 A * 10/1920 Avery ..... 220/689
1,564,472 A * 12/1925 Daly et al.
1,667,996 A * 5/1928 Westbye ..... 144/208.9
1,790,478 A * 1/1931 Kerr ..... 122/365
1,808,483 A * 6/1931 Ward ..... 220/801
1,818,032 A * 6/1931 Bell ..... 68/143
1,977,408 A * 10/1934 Schenck ..... 220/213
2,245,103 A * 6/1941 Field ..... 403/42
2,438,597 A * 3/1948 Batina ..... 68/142
2,470,459 A * 5/1949 Guthrie ..... 217/44
3,170,525 A * 2/1965 Kvello-Aune ..... 175/218
3,281,905 A * 11/1966 Wagner ..... 24/33 C

FOREIGN PATENT DOCUMENTS

DE 30 23 234 A1 1/1982
DE 198 21 366 C1 8/1999
EP 0 395 859 A1 11/1990

* cited by examiner

*Primary Examiner*—Frankie L. Stinson
(74) *Attorney, Agent, or Firm*—John T. Winburn; Russell W. Warnock; Craig J. Locst

(57) ABSTRACT

A laundry drum is configured for high-speed spinning of damp linen. The drum has a rotating drum shell, which is curved from a thin-walled material strip to form a cylinder. The parallel end edges of the material strip contact to form a joint line. So that the drum may resist drum speeds higher than 1500 rpm, the end edges have a slot-shaped teething. The teeth and of the teething engage into the respective tooth gaps of the opposite end edge, so that the base lines of the tooth gaps meet to form an at least approximately straight line. The teeth are fitted into the non-toothed zone of the end edge outside of the drum above the material strip, each tooth being firmly secured to the respective non-toothed zone.

5 Claims, 2 Drawing Sheets

WASHING-MACHINE LAUNDRY DRUM

CROSS-REFERENCE TO RELATED APPLICATION

This application is a continuation, under 35 U.S.C. § 120, of copending international application No. PCT/EP02/09350, filed Aug. 21, 2002, which designated the United States; this application also claims the priority, under35 U.S.C. § 119, of German patent application No. 101 63 186.3, filed Dec. 21, 2001; the prior applications are herewith incorporated by reference in their entirety.

BACKGROUND OF THE INVENTION

FIELD OF THE INVENTION

The invention pertains to a laundry drum for a washing-machine which is intended for high-speed spinning of wet laundry. The laundry drum has a rotating drum shell which is bent into a cylinder from a thin-walled strip of material such that the parallel end edges of the strip of material are in contact with one another along a connecting seam.

Such a laundry drum is known from European patent EP 395 859 B1. That laundry drum has a customary connecting seam in which the end edges of the drum-shell strip are bent over and interlocked and, by virtue of an additional angled portion, are shaped such that the interlocked end edges cannot be released from one another. Laundry drums with a connecting seam configured in this way are suitable for high-speed spinning at spinning speeds of up to 1000 rpm. The European patent, furthermore, proposes providing the connecting seam with bead-like embossed portions located transversely to the connecting seam, in order to render the seam stable enough for laundry drums formed in such a way to be suitable for spinning speeds of up to approximately 1500 rpm. For laundry drums which are to be operated at even higher spinning speeds, it is necessary to take additional measures to prevent the tensile forces in the drum shell from becoming excessively high, in order to protect the interlocked and embossed connecting seam against rupturing.

SUMMARY OF THE INVENTION

It is accordingly an object of the invention to provide a laundry drum for a washing machine which overcomes the above-mentioned disadvantages of the heretofore-known devices of this general type and which has a laundry drum provided with a connecting seam that, without additional outlay, withstands tensile forces in the shell which occur at speeds of above 1500 rpm.

With the foregoing and other objects in view there is provided, in accordance with the invention, a washing-machine laundry drum suitable for high-speed spinning of wet laundry, comprising:

a rotatable drum shell formed of thin-walled strip material having substantially parallel end edges and bent into a cylinder with said parallel end edges contacting one another along a connecting seam;

said end edges having a crenellated toothing formation formed with teeth and tooth gaps defined by tooth-gap base lines, said teeth engaging in respective said tooth gaps of a mating said end edge;

said tooth-gap base lines of said end edges butting against one another and forming a substantially straight line; and said teeth projecting onto non-toothed regions beyond said straight line on an outer surface of said cylinder, and being fixed to said non-toothed regions.

The term crenellations and crenellated is used in its broadest meaning to denote an edge structure with alternating projections (teeth) and voids (gaps), similar to battlements with merlons and crenels.

As noted above, the term "high-speed spinning" refers to rotational speeds in excess of approximately 1500 rpm (revolutions per minute).

The objects of the invention are achieved in that the end edges have a crenellated toothing formation, of which the teeth engage in the tooth gap of the mating end edge in each case such that the base lines of the tooth gaps, butting against one another, form an at least more or less straight line and the teeth abut in the non-toothed region of the end edge outside the drum, above the strip of material, and are fixed there to the region. A connecting seam which is configured in this way, by virtue of the arrangement of numerous teeth, is suitable, via the numerous connections between the teeth and the region, of achieving a high level of stability which withstand up to four times higher tensile forces in the shell than in the case of prior-art laundry drums.

In order that the drum shell remains virtually smooth on the inside, the invention is advantageously developed in that the teeth are angled outside the drum by the wall thickness of the strip of material. It is thus the case that the teeth overlapping the non-toothed region only jut out on the outside of the drum shell.

In accordance with an added feature of the invention, the connection between the teeth and the non-toothed region is particularly advantageously formed from at least in each case one riveted joint between the region and the abutting tooth. The riveted joint may be configured such that only slight burr-free elevations in the connecting region are produced on the inside shell.

An advantageous development of the invention which is completely without elevations on the inside of the shell is one in which the riveted joint is formed from a protuberance which is directed in tubular form outside the drum in the non-toothed region, extends through a hole in the tooth and is then bent over behind the tooth.

In accordance with a concomitant feature of the invention, which provides for a very advantageous development, the laundry located within the laundry drum is protected by any configuration of the connecting seam in that a carry-along element which covers the connecting seam is fitted on the inside of the shell.

Other features which are considered as characteristic for the invention are set forth in the appended claims.

Although the invention is illustrated and described herein as embodied in a washing-machine laundry drum, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
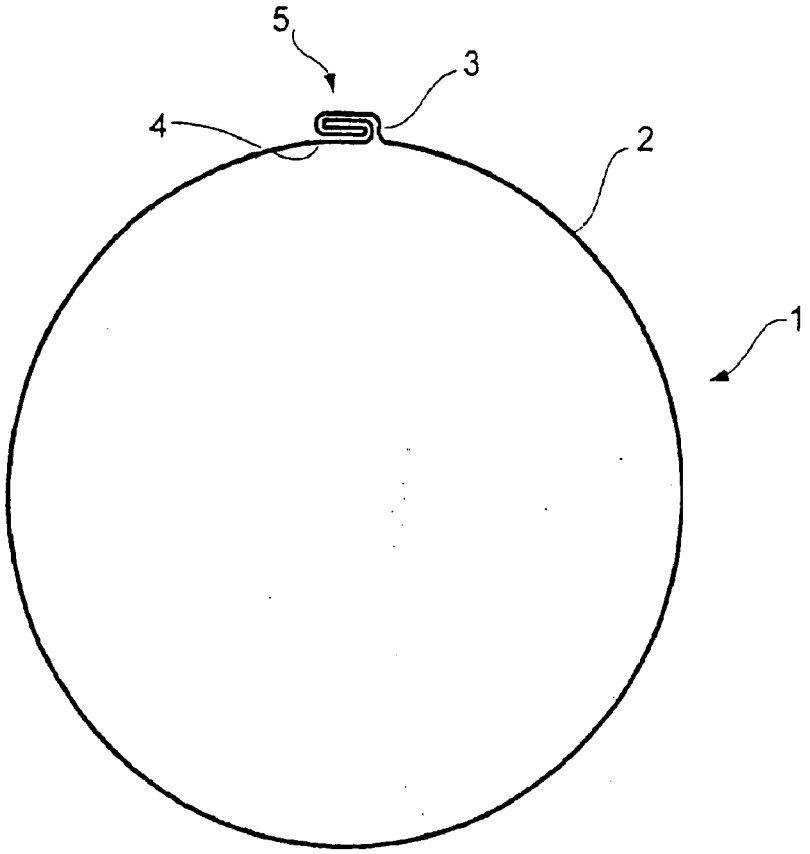
FIG. 1 Prior Art
FIG. 1 is a vertical section through a laundry drum in which the connecting seam is formed according to prior art.

Referring now to the figures of the drawing in detail and first, particularly, to FIG. 1 thereof, there is shown a laundry drum 1 with a rotating drum shell 2 which is bent into a cylinder from a thin-walled strip of material. The material may, customarily, be stainless sheet steel. The end edges 3 and 4 of the bent cylinder are joined to form a connecting seam 5 (illustrated on a vastly enlarged scale here) which, according to the prior art, has two interlocked folds, of which the top fold is angled in front of the front edge of the bottom fold in the direction of the inner circle line of the drum shell.

Figure 2:
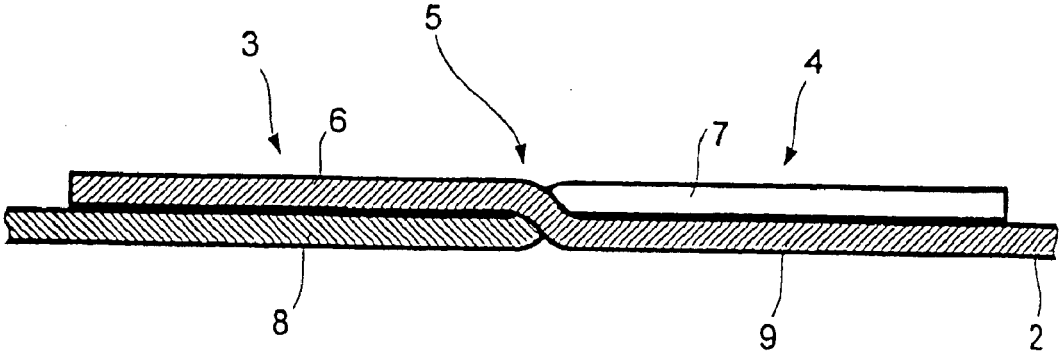
FIG. 2 is an enlarged partial sectional view of a cross section through the connecting seam according to the invention.

Referring now to FIG. 2, the connecting seam 5 according to the invention is formed from meshed teeth 6 and 7 which butt against the outside of the drum in the non-toothed region 8, 9 of the drum shell. The teeth 6 and 7 can be connected in any desired manner to the respective non-toothed region 8, 9 of the mating end edge 4, 3. Thus, for example, spot welding is suitable for producing a high strength of the seam 5. It is also possible, however, for slots to be arranged in the non-toothed region 8, 9, these being intended for accommodating ends of the teeth 6 and 7 which are bent toward the inside of the drum, the bent-over ends of the teeth, once the seam has been joined, being bent over further in the direction of the seam on the inside of the drum. Nevertheless, such a seam has to be covered from the inside in order that the laundry is protected.

Figure 3:
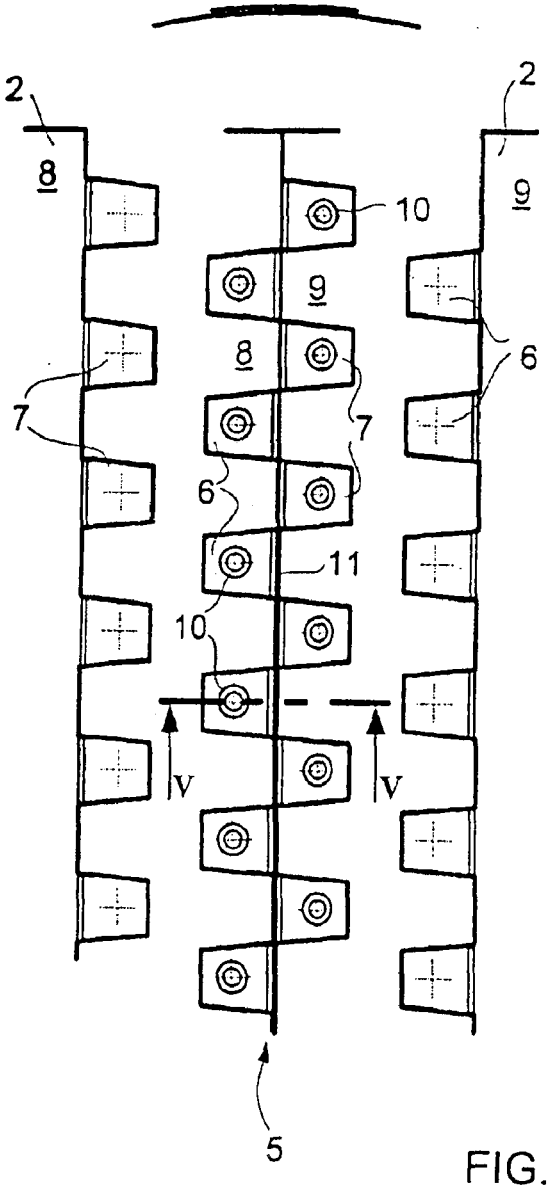
FIG. 3 is a double view illustrating in the upper view a smaller illustration of the detail shown in FIG. 2, the cross section of the drum seam and, in the lower view underneath, a view of the connected connecting seam from outside the drum and a schematic illustration of the end edges prior to the connecting seam being joined.

In contrast, FIG. 3 shows a seam which has been joined in accordance with FIG. 2 and in which the teeth 6 and 7 and the non-toothed region 8, 9 are connected to one another by rivets 10. FIG. 3 shows very clearly that the base lines 11 of the tooth gaps here butt against one another. The series of abutting base lines 11 together form a more or less straight line.

Figure 4:
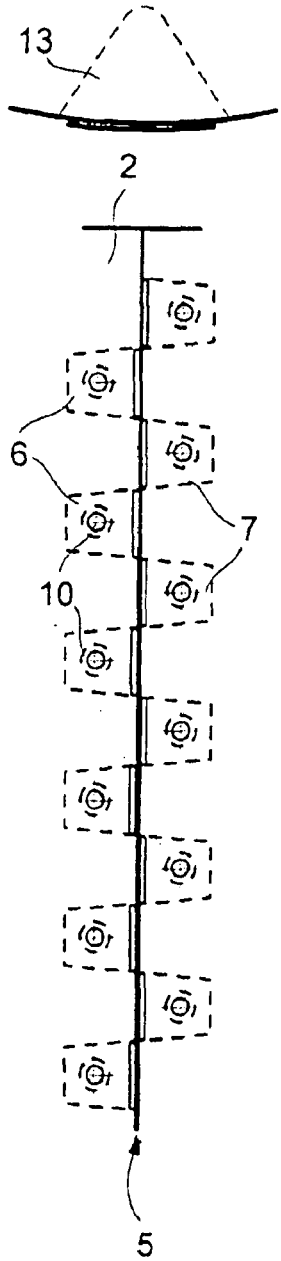
FIG. 4 is a similar double view showing, again in a smaller illustration of the detail of in FIG. 2, the cross section of the drum seam and, underneath, a view of the connecting seam from inside the drum.

FIG. 4 shows the joined seam 5 as seen from the inside of the drum shell 2. It can be seen that all the teeth 6 and 7 end up located outside the drum shell and, apart from the rivets 10, the inside remains completely smooth.

Figure 5:
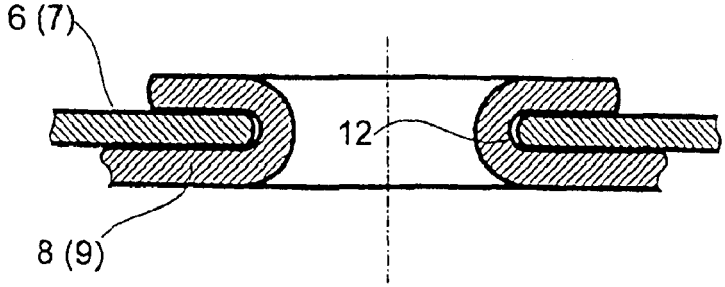
FIG. 5 is a cross section through a riveted joint taken along the line V—V in the connecting seam according to FIGS. 3 and 4.

With reference to FIG. 5, it is also possible for the rivets 10 to be configured such that they do not jut out on the inside of the drum shell 2. In this case, the tubular rivets are formed from a tubular protuberance in the region 8 or 9, the protuberance extending through a hole 12 in the tooth 6 or 7 and being bent over behind the tooth. It is expedient for the internal diameter of such a through-rivet 10 to be selected to be no larger than the diameter of non-illustrated flow holes which are otherwise present in the drum shell 2.

If the connecting seam 5 according to FIGS. 4 and 5 is not configured to be completely smooth on the inside of the drum shell 2, then arranging a carry-along element 13 (FIG. 4), the latter being necessary in any case, on the inside of the drum shell 2 precisely above the seam 5 can protect the laundry located within the laundry drum against coming into contact with jagged edges or other sharp-edged uneven structures.

It will be understood that the invention is not limited to the exemplary embodiment illustrated. In the exemplary embodiment, the teeth 6 and 7 are of markedly trapezoidal configuration. The inclination of the trapezoidal edges does not have any significant influence on the strength of the connecting seam 5. Even triangular teeth are conceivable. The inclination of the trapezoidal edges will be selected such that the operation of joining the end edges 3 and 4 does not pose any problems in producing the drum. The number of teeth and tooth gaps is left up to the discretion of the person skilled in the art in accordance with the configuration of the connecting seam and should only be based on the number of connecting locations within the connecting seam 5 which is to be selected for the necessary level of strength. It is not imperative for the connecting seam 5 to be located at right angles to the side edge of the drum shell 2. However, it is yet to be tried and tested as to whether, if the connecting seam 5 is positioned obliquely, an asymmetrical configuration of the tooth is more suitable than the symmetrical formation which is illustrated here.

I claim:

1. A washing-machine laundry drum suitable for high-speed spinning of wet laundry, comprising:

a rotatable drum shell formed of thin-walled strip material having substantially parallel end edges and bent into a cylinder with said parallel end edges contacting one another along a connecting seam;

said end edges having a crenellated toothing formation formed with teeth and tooth gaps defined by tooth-gap base lines, said teeth engaging in respective said tooth gaps of a mating said end edge;

said tooth-gap base lines of said end edges butting against one another and forming a substantially straight line; and said teeth projecting onto non-toothed regions beyond said straight line on an outer surface of said cylinder, and being fixed to said non-toothed regions.

2. The laundry drum according to claim 1, wherein said teeth are angled outwardly about a wall thickness of said strip material of said drum shell.

3. The laundry drum according to claim 1, wherein said teeth are fixed to said non-toothed regions with at least one riveted joint each.

4. The laundry drum according to claim 3, wherein said riveted joint comprises a substantially tubular protuberance projecting outwardly from said non-toothed region, through a hole formed in a respective said tooth, and crimped over behind said tooth.

5. The laundry drum according to claim 1, which comprises a carry-along element formed inside said drum shell and covering said connecting seam.

* * * * *